United States Patent [19]

Yrjälä

[11] Patent Number: 4,957,778

[45] Date of Patent: Sep. 18, 1990

[54] METHOD OF PRODUCING CHEMICALLY SELF-COPYING OR SELF-CONTAINING PAPER

[75] Inventor: Olavi A. Yrjälä, Espoo, Finland

[73] Assignee: A. Ahlstrom Corporation, Karhula, Finland

[21] Appl. No.: 380,036

[22] Filed: Jul. 14, 1989

Related U.S. Application Data

[62] Division of Ser. No. 204,309, Jun. 9, 1988, abandoned.

[30] Foreign Application Priority Data

Jun. 16, 1987 [FI] Finland ..... 872681

[51] Int. Cl.[5] ..... B41M 5/16

[52] U.S. Cl. ..... 427/152; 427/150; 503/200; 503/226

[58] Field of Search ..... 503/200, 226; 428/537.5; 427/150–152

[56] References Cited

U.S. PATENT DOCUMENTS

| | | | |
|---|---|---|---|
| 3,565,753 | 2/1971 | Yurkowitz | 162/127 |
| 4,496,961 | 7/1985 | Devrient | 428/199 |
| 4,629,630 | 4/1986 | Devrient | 427/150 |

FOREIGN PATENT DOCUMENTS

| | | | |
|---|---|---|---|
| 120965 | 7/1968 | Norway | 427/150 |

*Primary Examiner*—Pamela R. Schwartz
*Attorney, Agent, or Firm*—Nixon & Vanderhye

[57] ABSTRACT

A chemically self-copying paper intended for use in the combinations of a top sheet (CB), bottom sheet (CF) and one or more interleaving sheets (CFB) or a chemically copying, self-containing paper. The paper is formed of two fiber layers manufactured in separate wire sections and couched together while wet. The wire side of the upper fiber layer and the top surface of the lower fiber layer are couched together. The components inducing the color reaction are contained in the upper fiber layer which has been in contact with a smooth-surfaced press roll during the production of the paper.

6 Claims, 1 Drawing Sheet

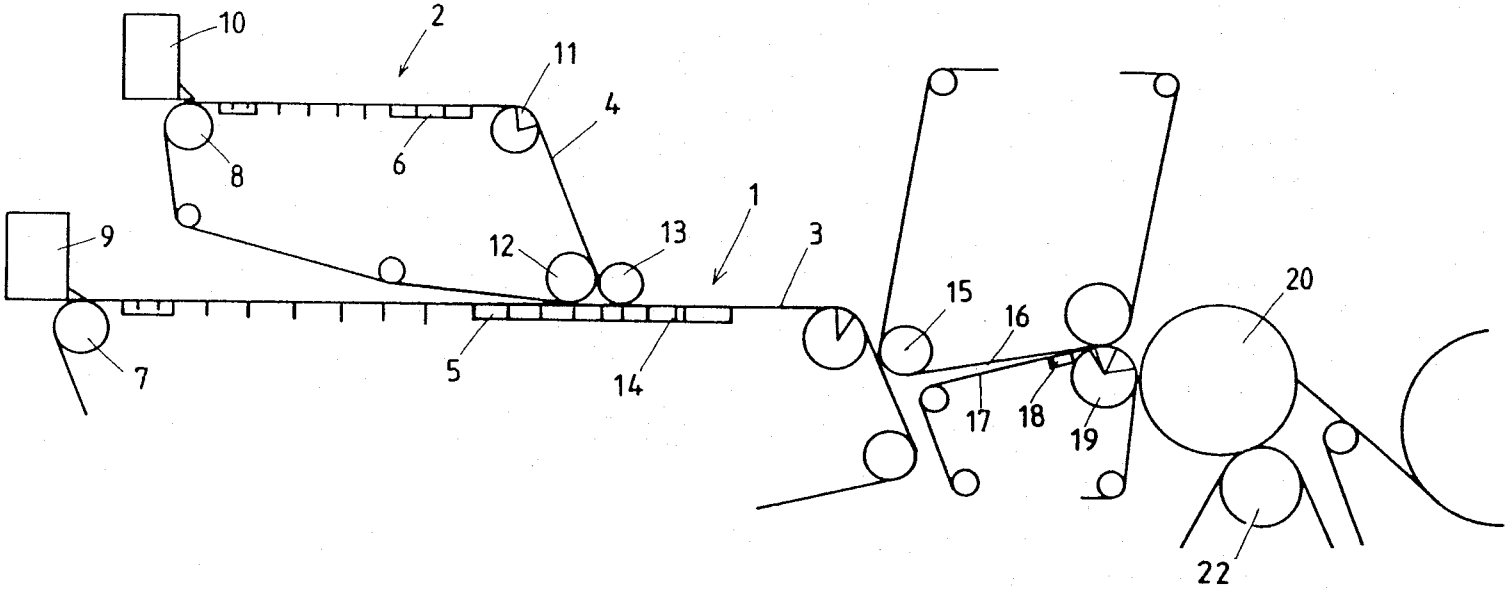
1
2
3
4
5
6
7
8
9
10
11
12
13
14
15
16
17
18
19
20
22

METHOD OF PRODUCING CHEMICALLY SELF-COPYING OR SELF-CONTAINING PAPER

This is a division of application Ser. No. 07/204,309, filed June 9, 1988, now abandoned.

The present invention relates to a chemically self-copying paper intended for use in combinations with a top sheet, bottom sheet and one or more interleaving sheets or to a chemically copying, self-containing paper and to a method of producing such.

Conventional, chemically self-copying paper refers to a combination of three different papers:

CB, in which the back of the paper is coated with microcapsules,

CFB, in which the top side of the paper is coated with either active clay or synthetic material, which coat reacts with colorless dye flowing from crushed capsules from the top sheet, thus inducing a color reaction, and CF, in which the top side of the paper is coated with either active clay or synthetic material, which coat reacts with colorless dye flowing from below the interleaving sheet CFB when the capsules are burst, thus inducing a color reaction.

Chemically copying, self-containing paper refers to a system with only one paper, which reacts to any text written on a sheet above or to other mechanical pressure application such being, for example, an embossed cash card or other payment card, a typewriter printing type without a ribbon, or a pen, etc.

Conventional, chemically self-copying or self-containing paper, which is mostly relatively thin in itself, always tends to curl for various reasons such as one-side coating, divergence of coating, drying in comparison with the body paper, and behaviour of the binding agent. In paper drying, the binding agent is inclined to migrate to the surface of the paper, which also impairs the copying ability. Such paper almost always requires separate handling to minimize or eliminate curling.

The object of the invention is to avoid the disadvantages described above and to provide a self-copying or self-containing paper with a low basis weight but still with a adequate bulk and stiffness. To achieve this objective, the paper is made in two separate wire sections, each with a headbox and a stock preparation system of its own. The webs are joined on the bottom wire in a place appropriate for web formation.

U.S. Pat. No. 4,629,630 discloses a method of making two-layer check paper, in which method the paper is made by couching together two fiber layers formed on separate sieves, one layer being formed of paper stock mixed with active clay and the other of paper stock mixed with microcapsules. In practice, the method is not applicable to making self-copying paper. The lowest basis weight produced by a sieve is usually appr. 40 $g/m^2$ in practice. The lowest basis weight of self-copying paper shall go down to 20 $g/m^2$. The maximum operating speed of sieves is with no special arrangements appr. 120 m/min, due to for example limited drainage cpacity. An economical minimum speed for self-copying paper is appr. 500 m/min, which calls for drainage capacity manifold in comparison with the abovementioned case.

In making the self-copying paper of the invention, the drainage from the upper fiber suspension is effected on a four-drinier wire stage by stage and carefully so as to leave the main components of the color reaction as near the top surface of the paper as possible, in CF paper the active clay, in CB paper the microcapsule and in self-containing paper both the active clay and the microcapsules. In the bottom layer of fiber, functioning as a barrier, drainage is effected on a four-drinier wire carefully and stage by stage in order that the components of the color reaction will penetrate into this layer as little as possible.

The properties of check papers shall be such that any kind of forging would be impossible, for example, that removing of the thin top layer would still not enable forging. Therefore, the color reaction in the depth direction mainly occurs inside the paper. In check papers, it is not a question of a color reaction at all taking place between two separate surface layers of paper, as is the case with most self-copying papers of the invention.

As with self-copying papers in general, the present invention also relates to a paper in which the color reaction is effected in the top layer of the paper. This is necessary to obtain a sufficient amount of legible copies of the given text. The clarity of the copy, depending on the intensity of the color reaction and on the total effect of other properties of the top layer of the paper, determines the number of legible copies. The details of the texts, such as the outlines of single letters, figures etc. shall be adequately sharp and unbroken. Considering also other demands set on self-copying paper, the invention forms a whole, each contributory factor being significant for the final result.

The self-copying or self-containing paper of the invention comprising two fiber layers is mainly characterized in that the wire side of the top fiber layer and the top surface of the lower fiber layer are couched together and that the components inducing the color reaction are disposed in the upper fiber layer which is in contact with a smooth-surfaced press roll during the papermaking process.

BRIEF DESCRIPTION OF THE DRAWING

The invention will be described further, by way of example, in the following, making reference to the attached drawing, which is a schematic illustration of a wire section and a press section of a paper machine designed for making paper according to the invention.

The paper machine illustrated in the figure comprises a bottom wire section 1 and a top wire section 2, the route of wires 3 and 4 of which sections is substantially horizontal on the portion supported by drainage elements known per se, such as suction boxes 5 and 6. The bottom and top wires are supplied with stock from headboxes 9 and 10 disposed in the vicinity of breast rolls 7 and 8.

A suction couch roll 11 and a wire turning roll 12 disposed inside the top wire loop guide the top wire 4 in a slanting position downwardly towards the bottom wire 3. The web formed in the top wire section is separated from the top wire. The wire side of the web and the top surface of the web formed in the bottom wire section 1 are couched together on the bottom wire by means of a roll 13 disposed outside the wire loops, whereafter drainage from both fiber layers takes place through the bottom wire by means of suction boxes 14 supporting the bottom wire. The 2-layer web is transferred by a pick-up roll 15 from the bottom wire to a pick-up felt 16 and further from the pick-up felt to a bottom felt 17 by means of a suction box 18 and a suction zone of a suction couch roll 19, which are disposed inside the bottom felt loop. The suction couch roll 19 and a smooth-surfaced counter-roll 20 form a first single-felted press nip whilst a roll 22 inside the felt loop and said counter-roll 20 form a second single-felted press nip. The web is conveyed through the press nips so that the top surface of the web on the wire 3 is disposed against the smooth surface of the counter-roll 20.

The main components inducing the color reaction, i.e. the active clay in CF paper, the microcapsules in CB paper and both the active clay and the microcapsules in self-containing paper, are mixed with the stock before the stock enters the wire. The stock containing components of the color reaction is fed into the headbox 10 of the top wire section. The headbox 9 of the bottom wire section is supplied with paper stock. Appropriate stocks are chosen for each layer. The top layer, for example, may contain mainly short-fiber stock and the bottom layer long-fiber stock. Various additives may be used in the stock, such as agents improving the retention and binding agents like starch.

The proportions of layers in a 2-layer web may vary depending on the quality demands, drainage capacity of the wires and filtering capacity of the bottom layer, etc. The objective is to keep the layer containing components of a relatively expensive color reaction as thin as possible.

A paper manufactured in this manner has several advantages over conventional paper made by a separate coating unit of a paper machine or with an off-machine coater. Such advantages are, for example, the following:

1. The paper has little or no tendency to curl.

2. Thanks to the nature of the 2-layer paper, the paper has higher bulk and stiffness, which enables a lower basis weight and improves the runnability of the paper and its use in various after-treatments (printing, set adhering, finishing treatment). The basis weight of ordinary, for example, selfcopying paper is today appr. 60 $g/m^2$. The arrangement of the invention facilitates 37–40 $g/m^2$. Less refining is required and the pinholes problem common with thin papers is eliminated. Properties of the 2-layer paper are of square type; the difference between the cross and longitudinal directions of the web becomes smaller when compared with a 1-layer paper.

This property also decreases the tendency of thin paper to curl in comparison with ordinary, coated self-copying paper.

3. An expensive and space consuming coating unit becomes unnecessary. The coating unit also calls for extra personnel both at the machine itself and in the coating kitchen. Broke from the coating unit is no longer produced. Addition of drying capacity required by the need for re-moisting the paper also becomes unnecessary, thus saving extra drying costs.

4. The self-containing paper of the invention is not so sensitive to handling as paper with capsules on both sides. A neutral layer, containing merely pulp, protects the capsules also during the manufacturing process. This advantage can be seen, for example, in the press section of the paper machine. The neutral layer facilitates manufacturing of a self-containing CB version, which is not possible with a corresponding 1-layer paper.

It is essential in manufacturing the paper of the invention that the wire side of the topmost layer and the top surface of the lower layer are couched together and that the web is transferred from the pick-up felt to the bottom felt before the first press nip. This web transfer action brings the top surface containing components of the color reaction against the smooth-surfaced counter-roll and the fiber layer (lower layer), protecting the microcapsules from being crushed, against the felt surface. This arrangement also forms a smoother and better printing surface and makes it possible to use a higher linear pressure in the press section. The bottom surface of the web is coarser and thus more appropriate for microcapsule coating. The capsules are sheltered by the hollows of the coarse bottom surface. CF paper or self-containing paper may be coated with microcapsules, in case the CF paper is further processed into CFB interleaving sheets or into combined self-containing CB.

The invention is not limited to the details described above which may vary within the inventive scope of the following claims.

We claim:

1. A method of producing a chemically self-copying paper intended for use in the combinations of a top sheet (CB), bottom sheet (CF) and one or more interleaving sheets (CFB) or a chemically copying, self-containing paper, said method comprising the steps of:

couching together, while wet, two fiber layers manufactured in separate wire sections, the wire side of the upper fiber layer and the top surface of the lower fiber layer being couched together to form a couched web in which the upper fiber layer contains components inducing a color reaction; and conveying said couched web through a single-felted press nip formed by a felt surface a smooth surface, so that said upper fiber layer containing the components inducing the color reaction contacts said smooth surface and said lower fiber layer contacts said felt surface.

2. A method as claimed in claim 1, wherein said bottom layer is made of paper stock and said top layer is made of paper stock mixed with active clay.

3. A method as claimed in claim 2, wherein the bottom surface of said bottom layer is coated with microcapsules.

4. A method as claimed in claim 1, wherein said bottom layer is made of paper stock and said top layer is made of paper stock mixed with microcapsules.

5. A method as claimed in claim 1, wherein said bottom layer is made of paper stock and said top layer is made of paper stock mixed with active clay and microcapsules.

6. A method as claimed in claim 5, wherein the bottom surface of said bottom layer is coated with microcapsules.

* * * * *